US007195511B1

(12) United States Patent
Ornt et al.

(10) Patent No.: US 7,195,511 B1
(45) Date of Patent: Mar. 27, 2007

(54) CABLE STRAIN RELIEF

(75) Inventors: Greg G. Ornt, Sodus Point, NY (US); Brent E. Raiber, Springville, NY (US); David J. Zwick, Pittsford, NY (US)

(73) Assignee: Harris Corporation, Melbourne, FL (US)

( * ) Notice: Subject to any disclaimer, the term of this patent is extended or adjusted under 35 U.S.C. 154(b) by 14 days.

(21) Appl. No.: 11/332,902

(22) Filed: Jan. 17, 2006

(51) Int. Cl.
*H01R 13/62* (2006.01)

(52) U.S. Cl. ..... 439/369; 439/458

(58) Field of Classification Search ..... 439/369, 439/370, 371
See application file for complete search history.

(56) References Cited

U.S. PATENT DOCUMENTS 3,781,761 A * 12/1973 Harwood ..... 439/369
5,423,693 A * 6/1995 Light ..... 439/369
5,695,356 A * 12/1997 Swanson ..... 439/369
6,012,940 A * 1/2000 Wheeler ..... 439/369
6,485,324 B1 * 11/2002 Belknap ..... 439/457
2005/0075003 A1 * 4/2005 Hatrich ..... 439/369

FOREIGN PATENT DOCUMENTS

FR 2555826 A1 * 5/1985

* cited by examiner

*Primary Examiner*—Hae Moon Hyeon
(74) *Attorney, Agent, or Firm*—Sacco & Associates, PA; Robert J. Sacco

(57) ABSTRACT

Cable strain relief device (100) for electronic equipment (400) that can be attached at any position on a cable (200). The device (100) can secure the cable (200) to any fixed point (402). The device can protect the cable connection (404) to the electronic equipment by transferring mechanical load placed on the cable (200) to a strong rigid location (402) on the equipment or any fixed point. It also protects the cable from damage typically associated with conventional clamping techniques.

17 Claims, 4 Drawing Sheets

CABLE STRAIN RELIEF

BACKGROUND OF THE INVENTION

1. Statement of the Technical Field

The inventive arrangements relate generally to strain relief devices for cables, and more particularly to a strain relief device that can be installed in the field without tools, independent of the cable manufacturing process.

2. Description of the Related Art

Electronic equipment, and especially communication equipment, routinely includes cables that extend from the equipment for various purposes. Some cables are directly wired into the equipment while other cables are attached to the equipment by means of removable connectors. The use of cables in this context has many advantages. For example, it can permit user controls, displays and transducers, such as microphones, to be moved for ease of user access.

Notwithstanding the benefits of such cables, they do have some practical drawbacks. For example, it is inevitable that users will exert a degree of tension on the cable. Current cable technology often allows such cables to be highly resistant to breakage or damage resulting from the application of such stresses. However, a connection point between the cable and the equipment is often somewhat less robust. Regardless of whether the cable is hard wired into the equipment or attached to the equipment by means of an electronic connector, the stresses that are applied to the connector are inevitably applied to the connection point. This often leads to physical damage at the connection point, as well as electrical failure. In many instances, these problems will render the equipment useless.

Various attempts have been made to address the problem associated with excessive strains applied to the connection point by the cable. However, many of those solutions require modification of the cable assembly by a technician. Moreover, existing solutions do not facilitate installation in the field, without tools.

SUMMARY OF THE INVENTION

The invention concerns a cable strain relief device for electronic equipment that can be attached at any position on the cable, and can secure the cable to any fixed point. The invention can protect the cable connection to the electronic equipment by transferring mechanical load placed on the cable to a strong rigid location on the equipment. It also protects the cable from damage typically associated with conventional clamping techniques. Finally, the strain relief device disclosed herein can be advantageously installed in the field, without tools, and is independent of the cable manufacturing process.

The cable strain relief device is formed from a rod-like member comprised of a rigid or semi-rigid material. The device has a first portion and a second portion contiguous with the first portion. The first portion of the rod member can be shaped to define a serpentine pattern that includes two or more transverse segments. Each of the transverse segments can extend in a generally linear direction transverse to an elongated length of the device. The transverse segments can each have an orientation that is generally parallel to at least one adjacent transverse segment. Two or more link segments are provided for connecting an end of each transverse segment to one or more adjacent transverse segment. The second portion of the rod member can include a J-shaped hook. The J-shaped hook can define a gape or hook opening that is opposed to at least one of the plurality of transverse segments.

One or more of the transverse segment can include a thickened face portion. A gap is defined between adjacent ones of the transverse segments. The gap is advantageously narrowed between the face portions relative to a space between a remaining portion of each the adjacent transverse segment. The larger space between the adjacent transverse segments defines a cable capture area. According to one aspect of the invention, each of the transverse segments can define a concave face within the cable capture area. Moreover, at least a portion of the cable capture area can have a textured surface for frictional engagement of a cable.

The link segments that connects one end of each the transverse segment to an adjacent transverse segment can have a certain predetermined resilience. Consequently, the gap described herein can be temporarily enlarged to facilitate insertion of a cable in the cable capture area. Thereafter, when the transverse segments are returned to their normal position in which the link segment is no longer flexed, the cable can be prevented from exiting from the cable capture area as a result of the relatively narrow gap.

DETAILED DESCRIPTION OF THE PREFERRED EMBODIMENTS

Figure 1:
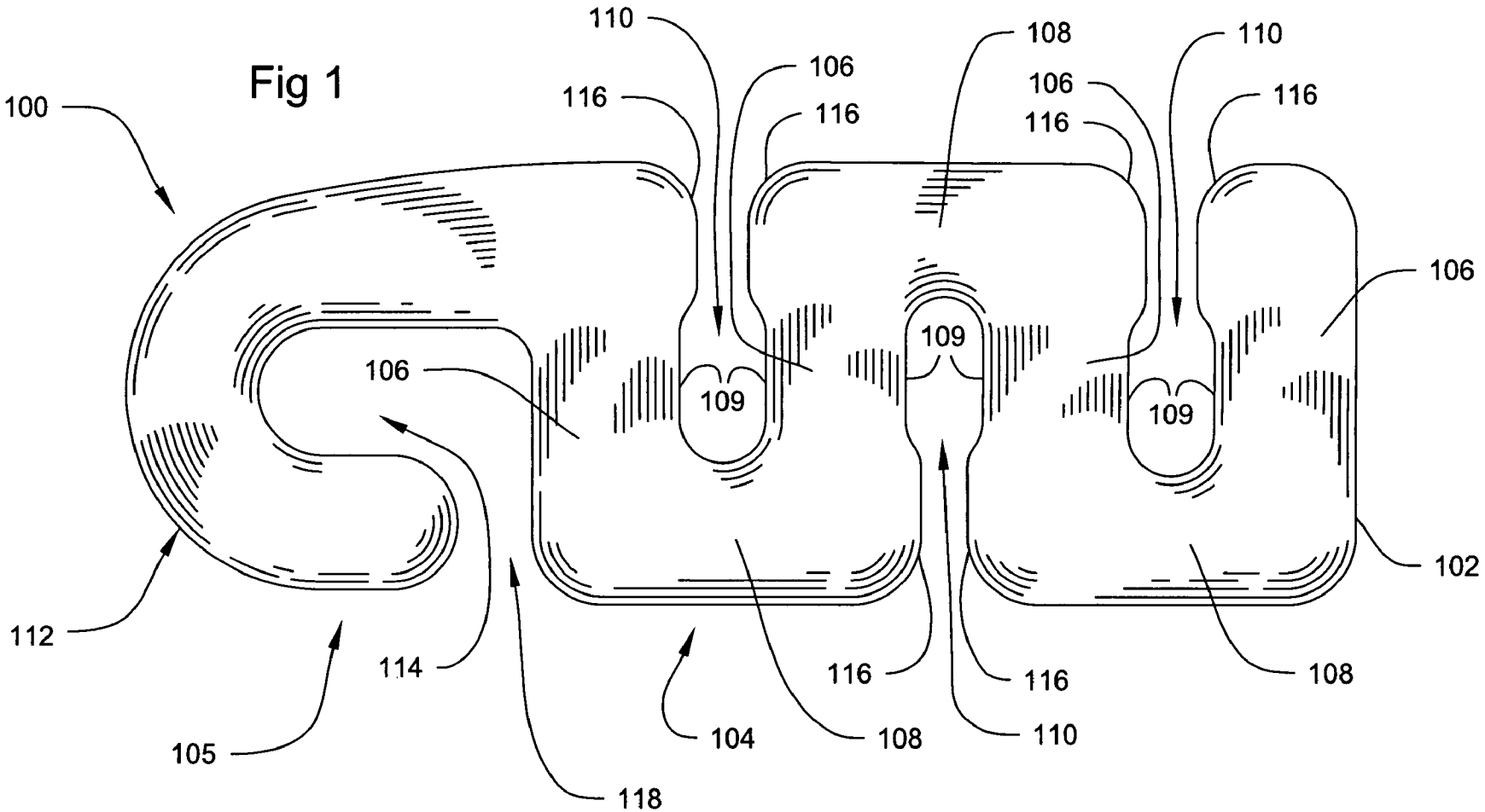
FIG. 1 is a top view of a cable strain relief device that is useful for understanding the invention.

An illustration of a cable strain relief device 100 is shown in FIG. 1. The cable strain relief device 100 can be formed from a rod member 102 which can be formed of a rigid or semi-rigid material. The device 100 has a first portion 104 and a second portion 105 that can be generally contiguous with the first portion. As shown in FIG. 1, the first portion 104 of the rod member 102 can be shaped to define a series of transverse segments 106 that are generally transverse to an elongated length of the device 100. The transverse segments 106 can be connected by a series of link segments 108 that extend in a direction that is generally aligned with an elongated length of the device 100. The exact arrangement of the transverse segments 106 and the link segments 108 are not critical provided that they define a series of cable capture areas 110.

The exact pattern defined by transverse segments 106 and the link segments 108 can vary somewhat within the scope of the present invention. According to one embodiment, the transverse segments 106 and the link segments 108 can be connected end to end to define a generally serpentine pattern as shown in FIG. 1. However, the invention is not limited in this regard and other patterns are also possible. The transverse segments 106 can be generally linear as shown in FIG. 1 or can be curved somewhat along their length. Further, the transverse segments 106 can each have an orientation that is generally the same direction as an orientation of at least one adjacent transverse segment. For example, the transverse segments 106 can be generally parallel to one another as shown in FIG. 1. The link segments 108 can connect at least one end portion of each transverse segment 106 to one or more adjacent transverse segments 106.

The second portion 105 of the rod member can include a J-shaped hook 112. The J-shaped hook can define a gape 114 that is opposed to at least one of the plurality of transverse segments 106. The J-shaped hook can also define an opening 118, the purpose of which shall become apparent from the further description of the invention provided below.

The cross-sectional profile of the transverse segments 106, the link segments 108, and the J-shaped hook 112 are not critical. According to one embodiment, however, the cross-sectional profile of these elements can be curved so as to define a cross-sectional profile that does not include sharp edges, at least with respect to those portions of the segments that are within the cable capture areas 110 and in the portion of the J-shaped hook 112 that defines the gape 114. Also, it should be understood that the cross-sectional profile of the rod member 102 can vary somewhat over the course of its length.

The strain relief device 100 can be formed of any suitable material. For example the device 100 can be formed from molded plastic resin. The device 100 can be made exclusively from the resin material or can include a core formed of a different material, such as metal. A variety of well known techniques can be used to form the device 100. These techniques can include thermoplastic or thermoset injection molding, blow molding, rotational molding, thermoforming, compression molding, resin transfer molding (RTM), and others.

Referring again to FIG. 1, one or more of the transverse segments 106 can include a thickened face portion 116. Further, it may be noted that a gap is defined between adjacent ones of the transverse segments 106. The gap is advantageously narrowed between the face portions 116 relative to a space between a remaining portion of each the adjacent transverse segment. The larger space between the adjacent transverse segments defines the cable capture area 110. According to one aspect of the invention, each of the transverse segments 106 can define a concave face 109 within the cable capture area 110. Moreover, at least a portion of the cable capture area can have a textured surface for frictional engagement of a cable (not shown in FIG. 1).

Figure 2:
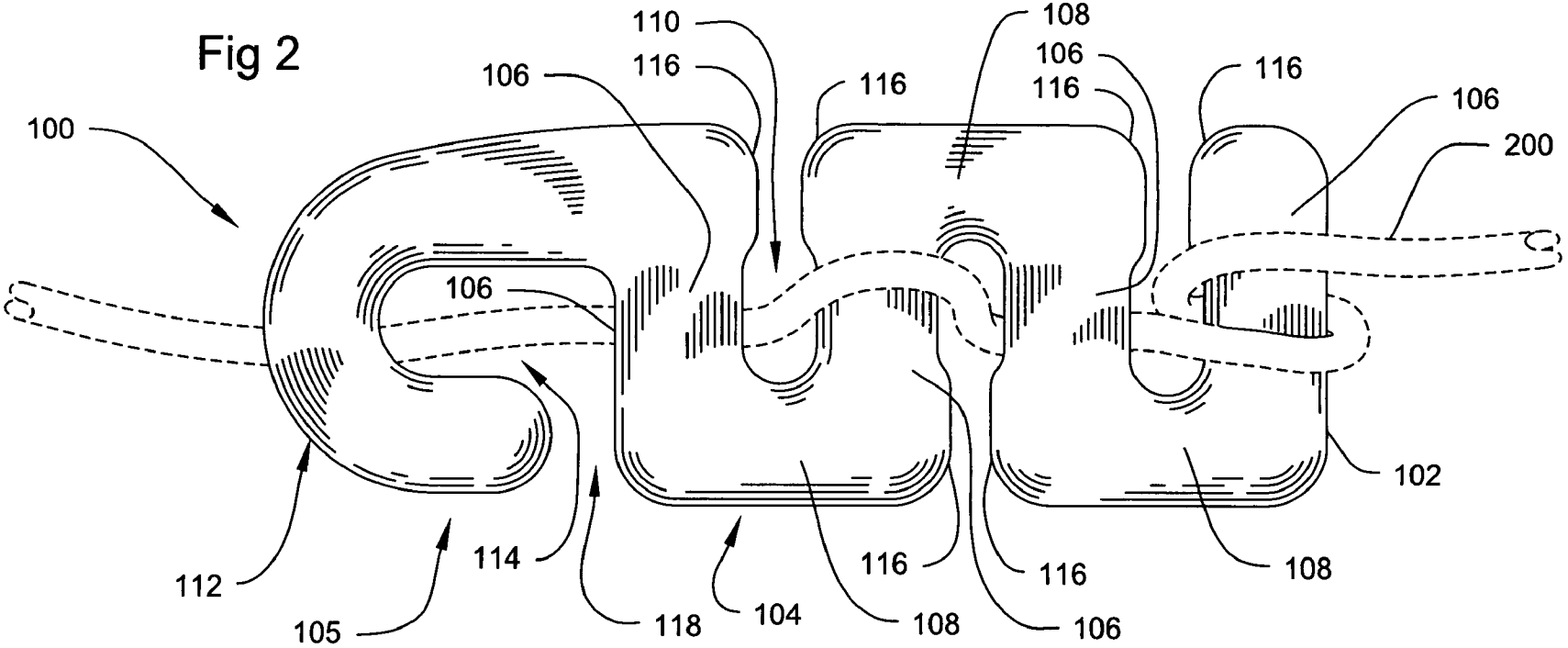
FIG. 2 is a top view of the cable strain relief device in FIG. 1, with a cable positioned within the device.
Figure 3:
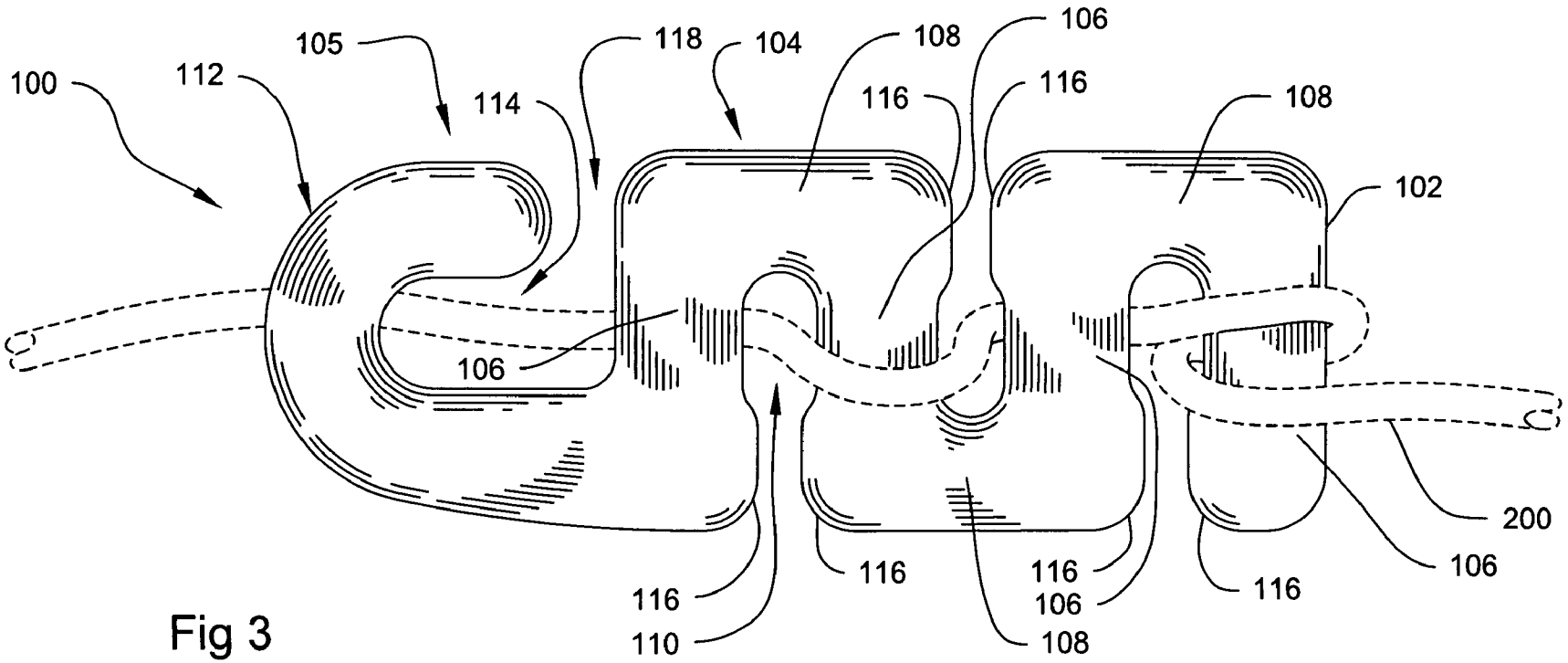
FIG. 3 is a bottom view of the cable strain relief device in FIG. 1, with a cable positioned within the device.

Referring now to FIGS. 2 and 3, there are shown a top and a bottom view of the device 100 with a cable 200 secured within the cable capture areas 110 defined by the transverse segments 106 and the link segments 108. While a single cable 200 is shown, it can be appreciated by persons of ordinary skill that more than one cable may be secured with the strain relief device 100. It can be observed in FIGS. 2 and 3 that the cable can pass through one or more of the cable capture areas 110. The cable 200 can also engage one or more of the transverse segments 106. It will be appreciated in FIGS. 2 and 3 that the concave faces 109 and the rounded cross-sectional profile of the transverse links 106 can minimize any abrasion or kinking of the cable 200 that might otherwise be caused by the device 100. In addition to traversing one or more of the cable capture areas in a generally serpentine pattern, it can be observed that the cable 200 can also be wrapped about a circumference of one or more of the transverse segments 106. For example, the transverse segment disposed at an end of the device 100 opposed from the J-shaped hook can be used for this purpose. The frictional engagement of the cable 200 with the transverse segments 106 can securely lock the device 100 in a predetermined position along the length of the cable.

Notably, the diameter of the cable 200 can be slightly larger than the gap formed between opposing ones of the thickened face portions 116. This difference in size can help to ensure that the cable 200 does not exit the cable capture area 110. Still, the narrowed opening formed between the thickened face portions can interfere in some instances with the insertion of the cable 200 in the cable capture area. In order to address this potential problem, the link segments 108 that connect one end of each the transverse segment 106 to an adjacent transverse segment 106 can have a limited amount of resilience. Similarly, the transverse segments can exhibit a limited amount of resilience or flex. Consequently, the gap between the thickened face portions 116 described herein can be temporarily enlarged by flexing one or more of the link segments 108 and/or the transverse segments 106. This flexing can facilitate insertion of cable 200 within the cable capture area 110. Thereafter, when the transverse segments 106 are returned to their normal position in which the segment or segments are no longer flexed, the cable 200 can be prevented from exiting from the cable capture area 110 as a result of the relatively narrow gap.

Figure 4:
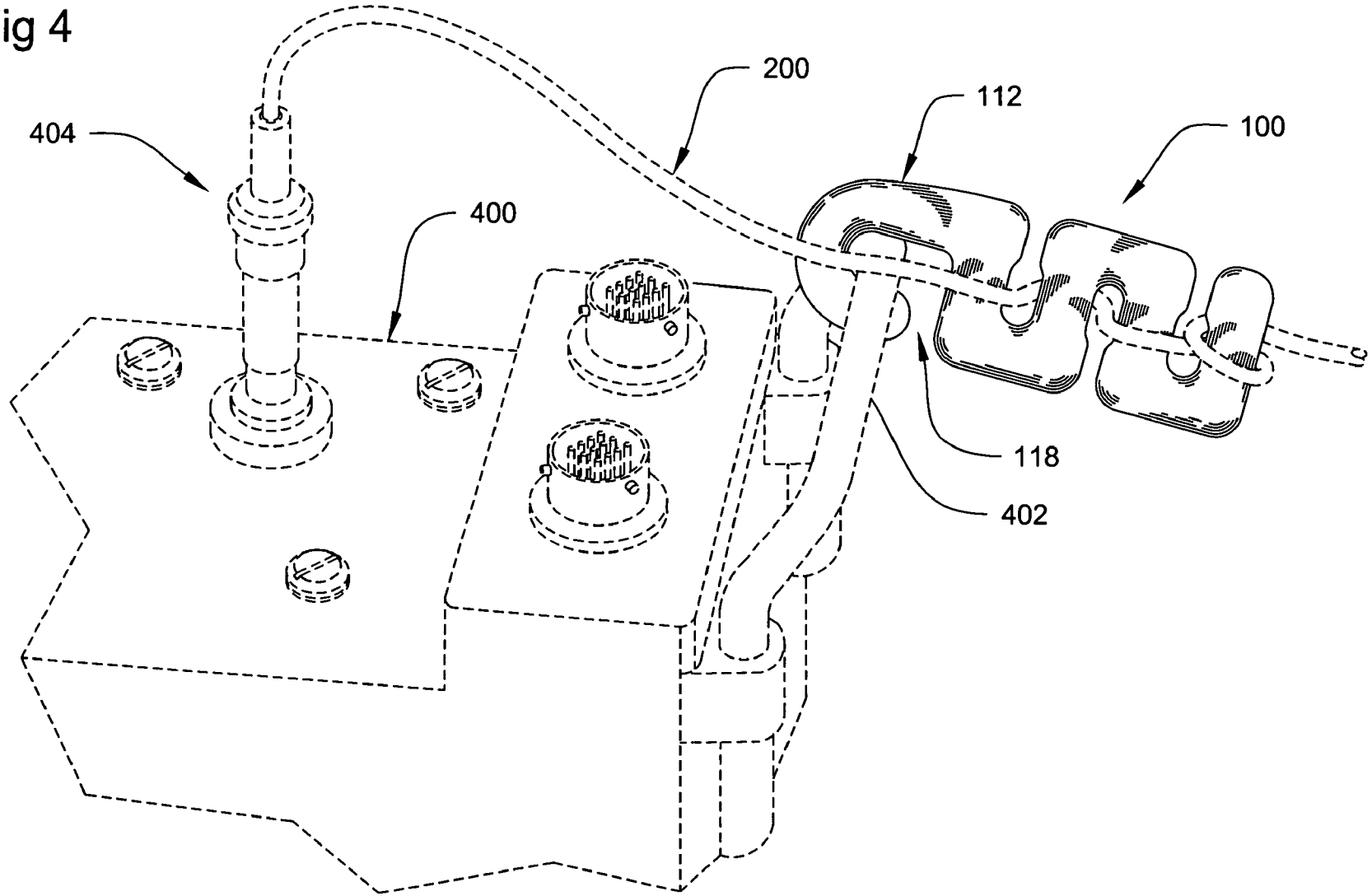
FIG. 4 is a perspective view of the cable strain relief device in use with a piece of equipment.

Referring now to FIG. 4, the device 100 is shown being used in conjunction with equipment 400. As shown in FIG. 4, the device 100 can be attached to a secure point on the equipment 400 by means of the J-shaped hook 112. For example, a handle 402 provided for lifting the equipment 400 can be used for this purpose. The handle 402 can be passed through the opening 118 defined in the J-shaped hook and inserted into the gape 114. Thereafter, tension exerted on the cable 200 will not be transferred to a connector 404. Instead, such tension will be exerted on the rigid structure provided by handle 402. The use of the device 100 in this way can prevent damage to the handle 404.

The invention described and claimed herein is not to be limited in scope by the preferred embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

We claim:

1. A cable strain relief device, comprising:

a rod member formed of a rigid material having a first portion and a second portion contiguous with said first portion;

said first portion of said rod member having a shape defined by a serpentine pattern and a second portion of said rod member comprising a J-shaped hook, said serpentine pattern comprised of a plurality of at least four transverse segments exclusive of said J-shaped hook, each said transverse segment extending in a linear direction transverse to an elongated length of said device and having an orientation that is generally parallel to at least one adjacent transverse segment;

wherein said J-shaped hook has an elongated u-shaped gape for removably securing said device to a rigid connection point on a piece of equipment exclusive of any additional tooling or clamping mechanism and said u-shaped gape defined by said J-shaped hook is opposed to at least one of said plurality of transverse segments.

2. The cable strain relief device according to claim 1, wherein a link segment connects at least one end of each said transverse segment to at least one adjacent transverse segment.

3. The cable strain relief device according to claim 1, wherein each said transverse segment further comprises opposing concave faces for receiving a cable.

4. The cable strain relief device according to claim 1, wherein at least one end of each said transverse segment Includes a thickened face portion, and a gap defined between adjacent ones of said transverse segments is narrowed between said face portions relative to a space between a remaining portion of each said adjacent transverse segment that defines a cable capture area.

5. The cable strain relief device according to claim 4, wherein a link segment connects at least one end of each said transverse segment to at least one adjacent transverse segment, said link segment having a predetermined resilience, whereby said gap can be temporarily enlarged to facilitate insertion of a cable in said cable capture area.

6. The cable strain relief device according to claim 4, wherein each said transverse segment defines a concave face within said cable capture area.

7. The cable strain relief device according to claim 4, wherein at least a portion of said cable capture area has a textured surface for frictional engagement of a cable.

8. A cable strain relief device, comprising:

a rod member formed of a rigid material having a first portion and a second portion contiguous with said first portion;

said first portion of said rod member having a shape defined by a pattern that Includes a plurality of transverse segments, each said transverse segment extending in a direction transverse to an elongated length of said device and having an orientation that is generally consistent with at least one adjacent transverse segment;

a plurality of link segments connecting at least one end of each said transverse segment to at least one adjacent transverse segment; and wherein said second portion of said rod member comprises a J-shaped hook, having an elongated u-shaped gape opposed to at least one of said plurality of transverse segments, said J-shaped hook for removably securing said device to a rigid connection point on a piece of equipment exclusive of any additional tooling or clamping mechanism.

9. The cable strain relief device according to claim 8, wherein at least one end of each said transverse segment includes a thickened face portion, and a gap defined between adjacent ones of said transverse segments is narrowed between said face portions relative to a space between a remaining portion of each said adjacent transverse segment that defines a cable capture area.

10. The cable strain relief device according to claim 9, wherein each said link segment connects at least one end of each said transverse segment to at least one adjacent transverse segment, said link segment having a predetermined resilience, whereby said gap is capable of being temporarily enlarged to facilitate insertion of a cable in said cable capture area.

11. The cable strain relief device according to claim 9, wherein each said transverse segment defines a concave face within said cable capture area.

12. The cable strain relief device according to claim 9, wherein at least a portion of said cable capture area has a textured surface for frictional engagement of a cable.

13. A method for relieving cable strain, comprising:

providing a cable relief device having a plurality of cable capture areas formed from a plurality of transverse segments that are linked together and extend in a direction transverse to an elongated length of the device, each having an orientation that is generally consistent with at least one adjacent transverse segment;

routing a cable in a serpentine pattern through said plurality of cable capture areas to secure said cable within said cable capture areas exclusive of any clamping mechanism or any tooling;

providing a J-hook on one end of said device with an elongated u-shaped gape opposed to an elongated length of at least one of said transverse segments; and removably securing said J-hook to a rigid connection point on a piece of equipment exclusive of any additional tooling or clamping mechanism.

14. The method according to claim 13, further comprising providing said plurality of transverse segments with a thickened face portion that narrows a gap defined between adjacent ones of said transverse segments between said face portions relative to a space between a remaining portion of each adjacent one of said transverse segment.

15. The method according to claim 14, further comprising flexing at least one of said link segment and said transverse segment to enlarge said gap between said face portions prior to insertion of said cable.

16. The method according to claim 13, further comprising looping said cable around at least one of said transverse segments.

17. The method according to claim 13, further comprising looping said cable around at least four of said transverse segments, exclusive of said J-hook.

* * * * *